United States Patent [19]

Rubin

[11] Patent Number: 4,700,049

[45] Date of Patent: Oct. 13, 1987

[54] WALL-MOUNTED ELECTRIC HAIR DRYER INCORPORATING DUAL-VOLTAGE ELECTRIC SHAVER OUTLETS

[75] Inventor: Richard H. Rubin, Hout Bay, South Africa

[73] Assignee: Panache Promotions (Proprietary) Limited, Athlone, South Africa

[21] Appl. No.: 764,867

[22] Filed: Aug. 12, 1985

[30] Foreign Application Priority Data

Aug. 13, 1984 [ZA] South Africa ..... 84/6270

[51] Int. Cl.[4] ..... H05B 1/00; H05B 1/02; A45D 20/16; F24H 3/02

[52] U.S. Cl. ..... 219/370; 34/97; 34/243 R; 219/364; 219/366; 219/373; 219/380; 219/472

[58] Field of Search ..... 219/373, 379, 380, 364, 219/370, 369, 366, 242, 472, 213; 34/96–101, 243 R; 98/200.2; 363/143

[56] References Cited

U.S. PATENT DOCUMENTS

| | | | |
|---|---|---|---|
| 1,452,085 | 4/1923 | Machol | 219/373 X |
| 2,646,496 | 7/1953 | Takach | 98/2.02 X |
| 2,698,894 | 1/1955 | Stein | 219/364 |
| 3,076,887 | 2/1963 | Bulow | 34/243 R |
| 3,384,977 | 5/1968 | Rosenberg | 219/370 X |
| 3,449,838 | 6/1969 | Chancellor | 219/370 X |
| 4,195,416 | 4/1980 | Hall | 34/97 X |
| 4,276,631 | 6/1981 | Fujita et al. | 368/89 |
| 4,366,366 | 12/1986 | Ekblad | 219/247 |

FOREIGN PATENT DOCUMENTS

| | | | |
|---|---|---|---|
| 49825 | 4/1982 | European Pat. Off. | 219/370 |
| 0126777 | 12/1984 | European Pat. Off. . | |
| 794827 | 12/1935 | France | 219/373 |
| 2297387 | 6/1976 | France . | |
| 2395677 | 9/1979 | France . | |
| 2478973 | 10/1981 | France | 34/97 |
| WO84/01276 | 12/1984 | PCT Int'l Appl. . | |
| 487425 | 6/1938 | United Kingdom | 34/243 R |

*Primary Examiner*—Anthony Bartis
*Attorney, Agent, or Firm*—Ladas & Parry

[57] ABSTRACT

A wall-mounted hair dryer has a casing which contains a heating element, a motor, an impeller and associated electrical circuitry. There is a flexible air hose terminating in a handle having an outlet for directing hot air onto the person of a user. The handle can be secured detachably magnetically against the casing, and a switch is provided to switch on the hair dryer when the handle is detached from the casing and to switch it off when the handle is replaced. A electronic timer circuit is also provided to switch off the hair dryer after a predetermined period of operation. Two shaver outlets are mounted on the casing and are connected to a dual-voltage current-limited transformer supplying one of the outlets with mains voltage (e.g., 110 volts) and the other outlet with twice the mains voltage (e.g., 220 volts), with the current to the outlets being limited to 0.1 ampere by a current limiting device.

9 Claims, 3 Drawing Figures

WALL-MOUNTED ELECTRIC HAIR DRYER INCORPORATING DUAL-VOLTAGE ELECTRIC SHAVER OUTLETS

BACKGROUND OF THE INVENTION

This invention relates to wall-mounted hair dryers.

Present wall-mounted hairdryers such as are found, for example, in hotel bathrooms, have several disadvantages. One disadvantage is that if the hair dryer is left on for an extended period, it may be damaged or present a safety hazard due to overheating, apart from wasting electrical energy. It has also been found that if the hair dryer is provided with a sufficiently powerful motor and heater element to be satisfactorily fast in operation, the hose and handle of the hair dryer may become uncomfortably hot in use and may need to be made uncomfortably heavy in order to withstand the heat absorbed.

It is an object of the invention to provide a wall-mounted hair dryer which is sufficiently powerful for normal requirements and which is relatively safe and convenient in use.

SUMMARY OF THE INVENTION

According to the invention, a wall-mounted hair dryer comprises a casing containing a heating element, a motor, an impeller and associated electrical circuitry, a flexible air hose terminating in a handle, the handle being provided with an outlet for directing heated air at the person of a user, means for detachably securing the handle against the casing, switching means arranged to switch on the hair dryer when the handle is detached from the casing and to switch off the hair dryer when the handle is replaced, and a timer arranged to automatically switch off the hair dryer after a predetermined period of operation.

The switching means may be a micro-switch having a linkage arranged to be operated by detachment and replacement of the handle.

The timer is preferably an electronic timing circuit arranged to switch the electrical supply to the hair dryer through a relay.

The hair dryer may include electrical outlets, for example for electric shavers, which are supplied from a separate electrical circuit to the main circuit of the hair dryer and which may be overload protected.

In a preferred embodiment, the hair dryer is provided with an air intake in the casing, the intake being shielded by a cowl which overlaps the intake to prevent the ingress of water into the interior of the hair dryer.

The hair dryer may include a thermostatic switch mounted near a heating element in the air path of the hair dryer and arranged to interrupt the electrical supply to the hair dryer if a preset temperature is exceeded.

The hose is preferably made of heat resistant ABS plastics material. The air passage in the handle between the end of the hose and the outlet is preferably sealed from the body of the handle and thermally insulated therefrom.

BRIEF DESCRIPTION OF THE DRAWINGS

A hair dryer according to the invention will now be described by way of example with reference to the accompanying drawings, in which.

DESCRIPTION OF A PREFERRED EMBODIMENT

Figure 1:
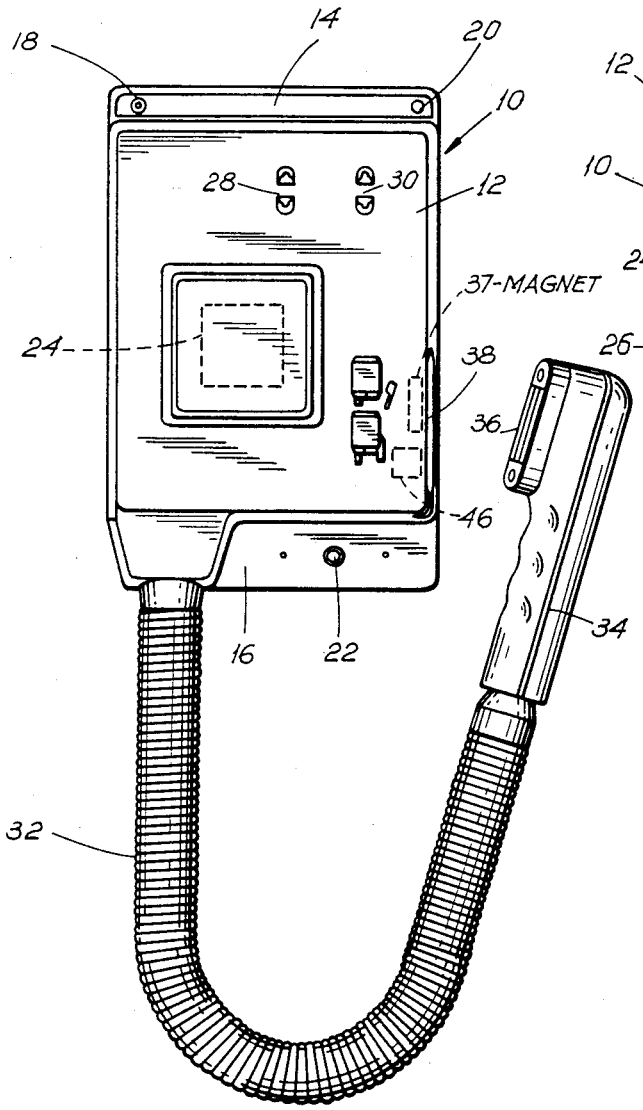
FIG. 1 is a front pictorial view of the hair dryer.
Figure 2:
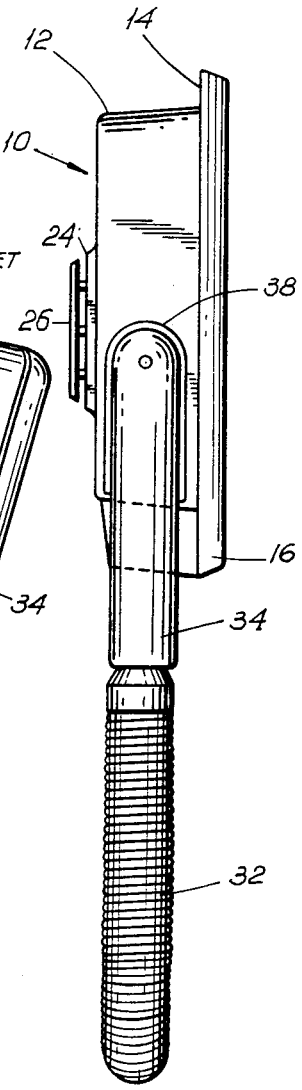
FIG. 2 is a side pictorial view of the hair dryer.

Referring firstly to FIGS. 1 and 2, a hair dryer 10 for mounting on a surface such as a wall has a moulded plastic casing 12. The casing 12 is provided at its top and bottom with flanges 14 and 16 in which are provided apertures 18, 20 and 22 by means of which the hair dryer may be fastened to the surface, for example by screws. On the front of the casing 12 is an air intake 24 which is covered by a cowl 26. The cowl 26 overlaps the intake 24 and prevents water which is splashed onto the casing 12 from entering the hair dryer 10, when, for instance, the hair dryer 10 is used in a bathroom. Also provided on the front of the casing 12 are outlets 28 and 30 for use, for example, with electric shavers.

Attached to the casing 12 near the bottom thereof is an air hose 32 of tough, heat resistant ABS (acrylonitrile-butadiene-styrene copolymer) plastic material. The hose 32 terminates in a handle 34 which has an air outlet 36 therein, through which heated air is exhausted when the hair dryer 10 is in operation. The handle 34 is mounted rotatably on the end of the hose 32. The air passage in the handle 34 is defined by a tube (not shown) which connects the end of the hose 32 to the outlet 36. The air passage is sealed from the body of the handle 34 and a layer of insulating material such as mica-impregnated sheeting or other insulating material insulates the handle 34 thermally from the tube. This prevents the handle 34 from becoming uncomfortably hot during use and permits the use of a heating element of higher rating than would otherwise be possible.

The part of the handle 34 carrying the outlet 36 is shaped to fit in a recess 38 provided in the casing 12. Magnets 37 in the recess 38 attract a metal grille which is fixed across the outlet 36 and thereby hold the handle firmly against the casing 12 when the hair dryer 10 is not in use.

The casing 12 contains the active components of the hair dryer, including a motor and impeller assembly, a heater element with a thermostatic switch, a micro-switch, a transformer for supplying power to the outlets 28 and 30, and an electronic circuit for controlling the operation of the hair dryer 10.

Figure 3:
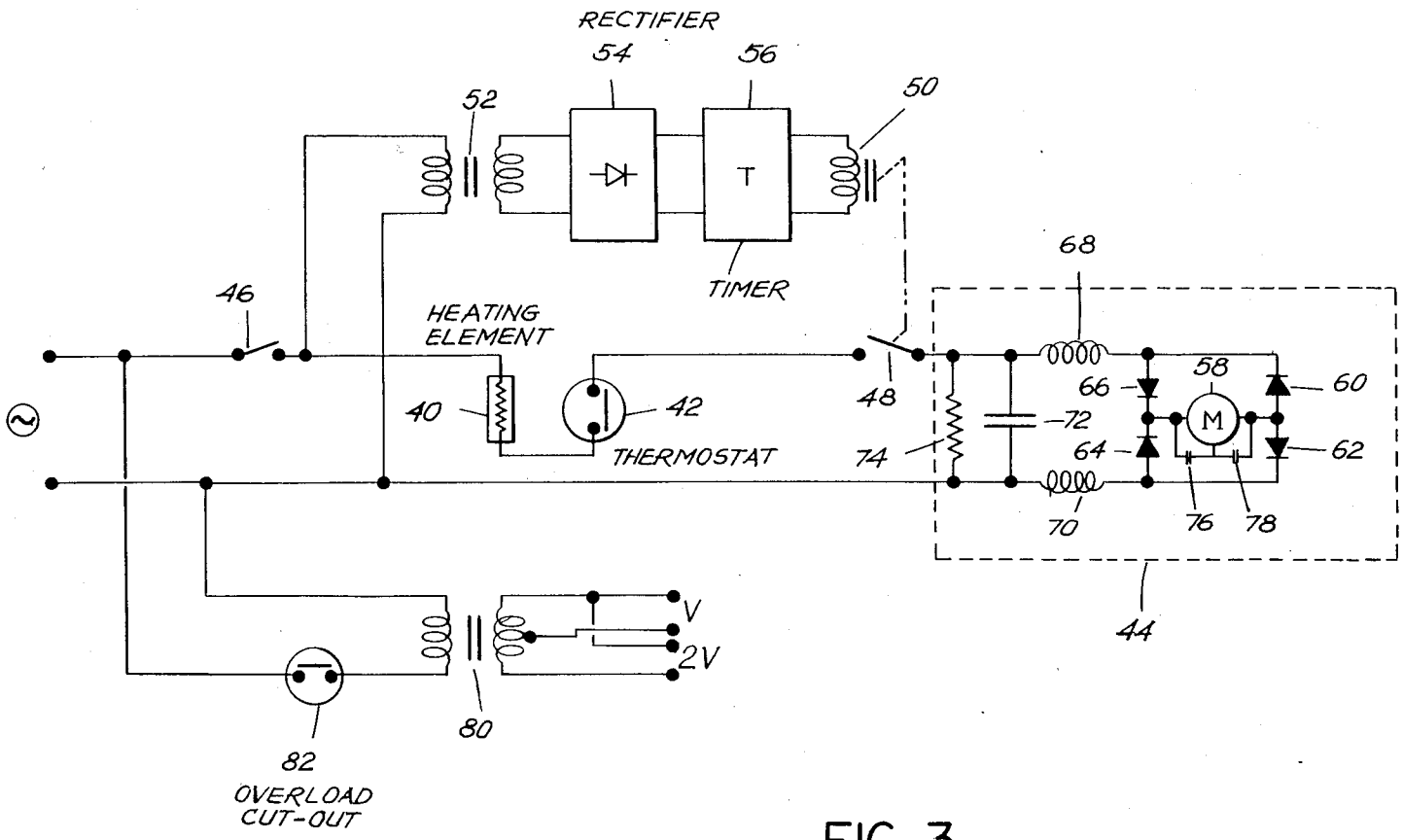
FIG. 3 is a schematic diagram of the electrical circuit of the hair dryer.

Referring now to FIG. 3, the electrical circuit of the hair dryer 10 is seen to comprise three basic sections. The first section includes the motor and heater element, the second section is a circuit for controlling the operation of the first section, and the third section is an independent circuit for supplying power to the outlets 28 and 30. All three sections are connected to the mains electrical supply.

A heater element 40 and its associated thermostatic switch 42 are connected in series with a motor circuit 44, a micro-switch 46, and the contacts 48 of a relay 50. The micro-switch 46 is arranged to be operated by an actuating button protruding into the recess 38 in the casing 12, and is closed when the handle 34 is removed from the recess 38, thereby connecting the heater element 40 and the motor circuit 44 to the electrical supply. The control circuit, comprising a 12 volt transformer 52, a rectifier bridge 54, a timer circuit 56 and the relay 50 are also connected to the supply. The timer circuit 56, which is a conventional electronic circuit assembled on a printed circuit board, immediately pulls in the relay 50, closing the normally open contacts 48.

The circuit including the heater element 40 and the motor circuit 44 is thus completed and the hair dryer 10 operates, providing a stream of heated air via the hose 32 and the outlet 36. The thermostatic switch 42 is mounted in close proximity to the heater element 40 and the normally closed contacts of the switch 42 open if the temperature in the vicinity thereof is above a predetermined limit, for example if the outlet 36 should be blocked. After a predetermined time period has elapsed the timer circuit 56 will de-activate the relay 50, even if the handle 34 is not returned to its rest position in the recess 38, thereby turning off the hair dryer 10. Normally, however, the user will replace the handle 34 in the recess 38, thereby opening the micro-switch 46, turning off the hair dryer 10, and resetting the timer circuit 56.

The motor circuit 44 comprises a DC motor 58 connected between a bridge of four diodes 60, 62, 64 and 66. In series with the motor 58 and the bridge are two chokes 68 and 70, while a capacitor 72 and a resistor 74 are connected in parallel across the input to the bridge. Connected between the positive and negative leads of the motor 58 and a screen surrounding the motor 58 are two capacitors 76 and 78. The diodes 60, 62, 64 and 66 rectify the current supplied to the motor 58, while the chokes 68 and 70, the capacitor 72 and the resistor 74, and the capacitors 76 and 78 filter electrical noise generated by the motor 58.

Although the motor 56 is a relatively low-voltage DC motor (typically of 12 to 24 volt rating), the use of the diodes 60, 62, 64 and 66 permit it to be used on an AC supply. The relative voltage drops across the motor circuit 44 and the heater element 40, which are connected in series and therefore form a voltage divider, are calculated so as to prevent the maximum rating of the motor 58 from being exceeded.

Independent of the above circuitry is a circuit for supplying shaver outlets 28 and 30 and comprising a center-tapped transformer 80, the primary winding of which is connected to the mains electrical supply in series with an overload cutout 82. The secondary windings of the transformer are connected to the outlets 28 and 30, with one outlet being supplied with the normal mains voltage and the other being supplied with either half or double the mains voltage, depending on whether the nominal mains voltage is higher or lower than that required. For example, if the mains voltage is 220 V, one outlet will be supplied with 220 V, while the other will be supplied by one half of the centre-tapped secondary winding with 110 V. The cutout 82 prevents more than a predetermined current, say 0.1 A from being drawn from the sockets.

I claim:

1. a wall mounted hair dryer comprising:

a casing having a cold air intake and a heated air outlet;

said casing containing an impeller powered by an electric motor and an electric heating element coupled to the electric mains and arranged to draw cold air through said intake and provide heated air at said outlet;

a flexible air hose having one end communicating with said outlet and another end having a handle terminating in a discharge air outlet for directing heated air at the person of the user;

two shaver outlets mounted on said casing and connected to a dual-voltage current-limited transformer coupled to said electric mains, said transformer supplying one of said shaver outlets with said mains voltage and the other of said outlets with twice said mains voltage, the current supplied to both of said outlets being limited to substantially the current drain of an electric shaver, whereby an electric outlet can be replaced by a hair dryer and two safety electric outlets for shavers, one outlet at the normal voltage and the other at twice the mains voltage.

2. The hair dryer of claim 1 wherein said transformer is coupled to said electric mains by a current-limiting device.

3. The hair dryer of claim 2 wherein said transformer is a center-tapped transformer.

4. The hair dryer of claim 2 wherein said current is limited to a substantially 0.1 ampere by said current limiting device.

5. The hair dryer of claim 1 further comprising:

holding means for detachably securing said handle against said casing during periods of non-use; switching means operably associated with electrical circuitry located in said casing and coupled between said mains and said electric motor and heating element, said circuitry including means for switching on said hair dryer in response to detachment of said handle from said casing and means for switching off said hair dryer in response to replacement of said handle in said holding means; and a timer located in said casing and coupled to said circuitry to switch off said hair dryer after a predetermined period of operation.

6. The hair dryer of claim 5 wherein said mains supply AC current and said motor is a low voltage DC motor connected in series with said heating element and a rectifier.

7. The hair dryer of claim 6 wherein said transformer is coupled to said eletric mains by a current-limiting device.

8. The hair dryer of claim 7 wherein said transformer is a center-tapper transformer.

9. The hair dryer of claim 8 wherein said current is limited to substantially 0.1 ampere by said current-limiting device.

* * * * *